US008162205B2

(12) United States Patent
Stephens

(10) Patent No.: US 8,162,205 B2
(45) Date of Patent: Apr. 24, 2012

(54) BLANKS FOR MAKING CONTAINERS AND RESULTING CONTAINERS HAVING DECORATED SURFACES

(75) Inventor: Jerry Ray Stephens, Hamilton, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 353 days.

(21) Appl. No.: 12/607,485

(22) Filed: Oct. 28, 2009

(65) Prior Publication Data

US 2011/0095074 A1 Apr. 28, 2011

(51) Int. Cl.
*B65D 5/06* (2006.01)

(52) U.S. Cl. ..... 229/110; D9/430; D9/433; 229/116.1; 229/128; 229/138; 229/156

(58) Field of Classification Search ..... 229/116.1, 229/108.1, 117.01, 125.42, 128, 137, 138, 229/155, 156; D9/430–433
See application file for complete search history.

(56) References Cited

U.S. PATENT DOCUMENTS

| | | | | |
|---|---|---|---|---|
| 727,723 | A | | 5/1903 | Webb |
| 924,681 | A | | 6/1909 | Ludescher |
| 2,047,804 | A | | 10/1934 | Shapiro |
| 2,077,173 | A | | 8/1935 | Holy |
| 2,160,488 | A | | 5/1936 | Ringler |
| 2,091,291 | A | | 8/1937 | Ringler |
| D112,661 | S | | 8/1938 | Lewis |
| 2,450,364 | A | | 9/1948 | Smith |
| D170,794 | S | | 11/1953 | Kolb |
| 2,670,127 | A | * | 2/1954 | Gleason et al. ..... 229/110 |
| 2,807,403 | A | * | 9/1957 | Joseph ..... 229/108.1 |
| 2,828,904 | A | | 1/1958 | Mires |
| 3,174,675 | A | | 3/1965 | Rosenburg, Jr. |
| 3,274,047 | A | | 9/1966 | Sloan |
| 3,450,331 | A | | 6/1969 | Tapiovaara |
| 3,549,081 | A | * | 12/1970 | Nelson ..... 229/138 |
| 3,668,796 | A | | 6/1972 | Patterson |
| 3,713,576 | A | * | 1/1973 | Goebel ..... 229/128 |
| 3,768,720 | A | | 10/1973 | Bundy |
| 3,773,246 | A | | 11/1973 | Tyrseck |
| 3,799,425 | A | | 3/1974 | Fanter |
| 3,977,594 | A | | 8/1976 | Swan |
| 3,985,285 | A | | 10/1976 | Kitagawa |
| 4,172,549 | A | | 10/1979 | Yoshida |
| 4,199,098 | A | | 4/1980 | Lopez |
| 4,201,331 | A | | 5/1980 | Austin |
| D255,778 | S | | 7/1980 | Albert |
| 4,260,100 | A | | 4/1981 | Hoffman |
| D270,042 | S | | 8/1983 | Fisher |
| 4,418,862 | A | | 12/1983 | Vesborg |
| D272,130 | S | | 1/1984 | Miyazaki |
| 4,492,723 | A | | 1/1985 | Chadwick, II |
| D280,703 | S | | 9/1985 | Strobe |

(Continued)

FOREIGN PATENT DOCUMENTS

JP 2006289028 A2 10/2006

*Primary Examiner* — Gary Elkins
(74) *Attorney, Agent, or Firm* — Peter D. Meyer

(57) ABSTRACT

The present invention is directed toward a polygonal container having at least five interconnected body panels and a blank for making the polygonal container. The ends of the polygonal container are provided with a plurality of pie-shaped triangular sections that can provide unique decorative experience to the user of a consumer product contained and dispensed from therein.

19 Claims, 8 Drawing Sheets

U.S. PATENT DOCUMENTS 4,712,725 A * 12/1987 Moore ..... 229/128
4,730,766 A * 3/1988 Fear ..... 229/137
4,768,701 A 9/1988 Gabbard
4,795,082 A 1/1989 Fujihara et al.
4,850,528 A 7/1989 Hanus
4,930,680 A 6/1990 Hanus
5,328,088 A * 7/1994 Lonczak ..... 229/157
5,393,579 A 2/1995 Witte
D362,619 S 9/1995 Haas
5,531,375 A 7/1996 Palm
5,558,272 A 9/1996 Magister
5,609,269 A 3/1997 Behnke et al.
D380,154 S 6/1997 Ryan
5,676,306 A 10/1997 Lankin et al.
D387,984 S 12/1997 Magister
5,738,272 A * 4/1998 Anchor et al. ..... 229/109
5,803,349 A * 9/1998 Ljungstrom ..... 229/137
D402,197 S 12/1998 Poulin
D406,058 S 2/1999 Allmon
5,871,144 A * 2/1999 Anchor et al. ..... 229/109
D410,196 S 5/1999 Berg
6,019,277 A * 2/2000 Lundstrom ..... 229/155
D442,084 S 5/2001 Hoffman et al.
D442,863 S 5/2001 Hoffman et al.
D444,062 S 6/2001 Harrison
D464,261 S 10/2002 Hereth
D508,649 S 8/2005 Ruiiland et al.
D534,071 S * 12/2006 Hoff ..... D9/430
D549,576 S 8/2007 Gray et al.
D588,453 S 3/2009 Glade
D616,300 S * 5/2010 Shaikh ..... D9/430
D620,792 S * 8/2010 Shaikh ..... D9/430
2002/0170950 A1 11/2002 Escamila
2009/0140034 A1 6/2009 Langendoen et al.

* cited by examiner

BLANKS FOR MAKING CONTAINERS AND RESULTING CONTAINERS HAVING DECORATED SURFACES

FIELD OF THE INVENTION

This invention relates to making six-sided, three-dimensional structures by folding flat sheet materials to form an article useful for decoration or, on a larger scale, an article used as a general purpose support structure. A specific provides both a package and container for forming a decorative polygonal container having at least six sides.

BACKGROUND OF THE INVENTION

A variety of containers that are presently in use are formed from one or more paperboard blanks that are divided by fold lines into a plurality of panels. This type of container has attained great popularity because it is inexpensive to produce and takes little storage space before it is folded and formed into a container suitable for containing articles of manufacture. In addition, it can be made attractive and provides adequate protection for many types of articles that may be disposed therein.

Most containers of this type include a top formed by a single rectangular top panel that is joined to a side panel along a fold line. If it is desired to have a more elaborate top or bottom portion, either for added structural protection or for aesthetic reasons, it has usually been necessary to depart from folded container construction, thus sacrificing any inherent advantages.

SUMMARY OF THE INVENTION

A first embodiment of the present disclosure provides for a blank of foldable material. The blank comprises a flat, substantially rectangular, blank of foldable material having top, bottom, left and right side edges, and a plurality of at least five interconnected body panels disposed between the left and right side edges. Each of the panels extends from the top edge and the bottom edge. The top edge and the bottom edge have a plurality of peaks and valleys. A first portion of the plurality of peaks and valleys are joined by curvilinear lines and a second portion of the peaks and valleys are joined by straight lines. The curvilinear lines joining the peaks and valleys of the top portion are adjacent at least one of the straight lines joining the peaks and valleys of the top portion. The blank also comprises a first plurality of fold lines adjacent both the top edge and the bottom edge. The first plurality of fold lines comprises a plurality of identical arch-shaped lines and a plurality of straight vertical lines. The arch-shaped fold lines are arranged side by side with the sides meeting and terminating at points on the valleys of both the top and bottom edges. The straight vertical fold lines connect the apexes of the arched shapes and the peaks along the top and bottom edges between the sides of the arches. The blank also comprises a second and third plurality of arch-shaped fold lines disposed between and connecting the apexes of the arched shapes. The second and third plurality of arch shaped fold lines are disposed generally parallel to each other and form a first plurality of regions. Each of the first plurality of regions separate each of the panels into a first body region, a second region containing the first plurality of fold lines adjacent to the top edge, and a third region containing the first plurality of fold lines adjacent to the bottom edge. The right and left side edges are joinable to first form a cylinder having a circumference defined by the at least five interconnected body panels. The top edge is folded inward along the fold lines and the bottom edge is folded inward along the fold lines to form a substantially flat panel at the top and a substantially flat panel at the bottom.

A second embodiment of the present disclosure provides for a polygonal container. The container comprises a flat, substantially rectangular, blank of foldable material having top, bottom, left and right side edges, and at least five interconnected body panels disposed between the left and right side edges. Each of the panels extends from the top edge and the bottom edge. The top edge and the bottom edge have a plurality of peaks and valleys. A first portion of the plurality of peaks and valleys are joined by curvilinear lines and a second portion of the peaks and valleys are joined by straight lines. The curvilinear lines joining the peaks and valleys of the top portion are adjacent at least one of the straight lines joining the peaks and valleys of the top portion. The blank also comprises a first plurality of fold lines adjacent both the top edge and the bottom edge. The first plurality of fold lines comprises a plurality of identical arch-shaped lines and a plurality of straight vertical lines. The arch-shaped fold lines are arranged side by side with the sides meeting and terminating at points on the valleys of both the top and bottom edges. The straight vertical fold lines connect the apexes of the arched shapes and the peaks along the top and bottom edges between the sides of the arches. The blank also comprises a second and third plurality of arch-shaped fold lines disposed between and connecting the apexes of the arched shapes. The second and third plurality of arch shaped fold lines are disposed generally parallel to each other and form a first plurality of regions. Each of the first plurality of regions separate each of the panels into a first body region, a second region containing the first plurality of fold lines adjacent to the top edge, and a third region containing the first plurality of fold lines adjacent to the bottom edge. The right and left side edges are joinable to first form a cylinder having a circumference defined by the at least five interconnected body panels. The top edge is folded inward along the fold lines and the bottom edge is folded inward along the fold lines to form a substantially flat panel at the top and a substantially flat panel at the bottom. Sealing means is disposed within a region of each flat panel circumscribed and formed by the top and bottom edges respectively.

DESCRIPTION OF THE PREFERRED EMBODIMENT

The term machine direction (MD) is known to those of skill in the art as the direction of travel of a web material through any processing equipment. The cross-machine direction (CD) is orthogonal and coplanar to the MD. The Z-direction is orthogonal to both the machine and cross-machine directions.

Figure 1:
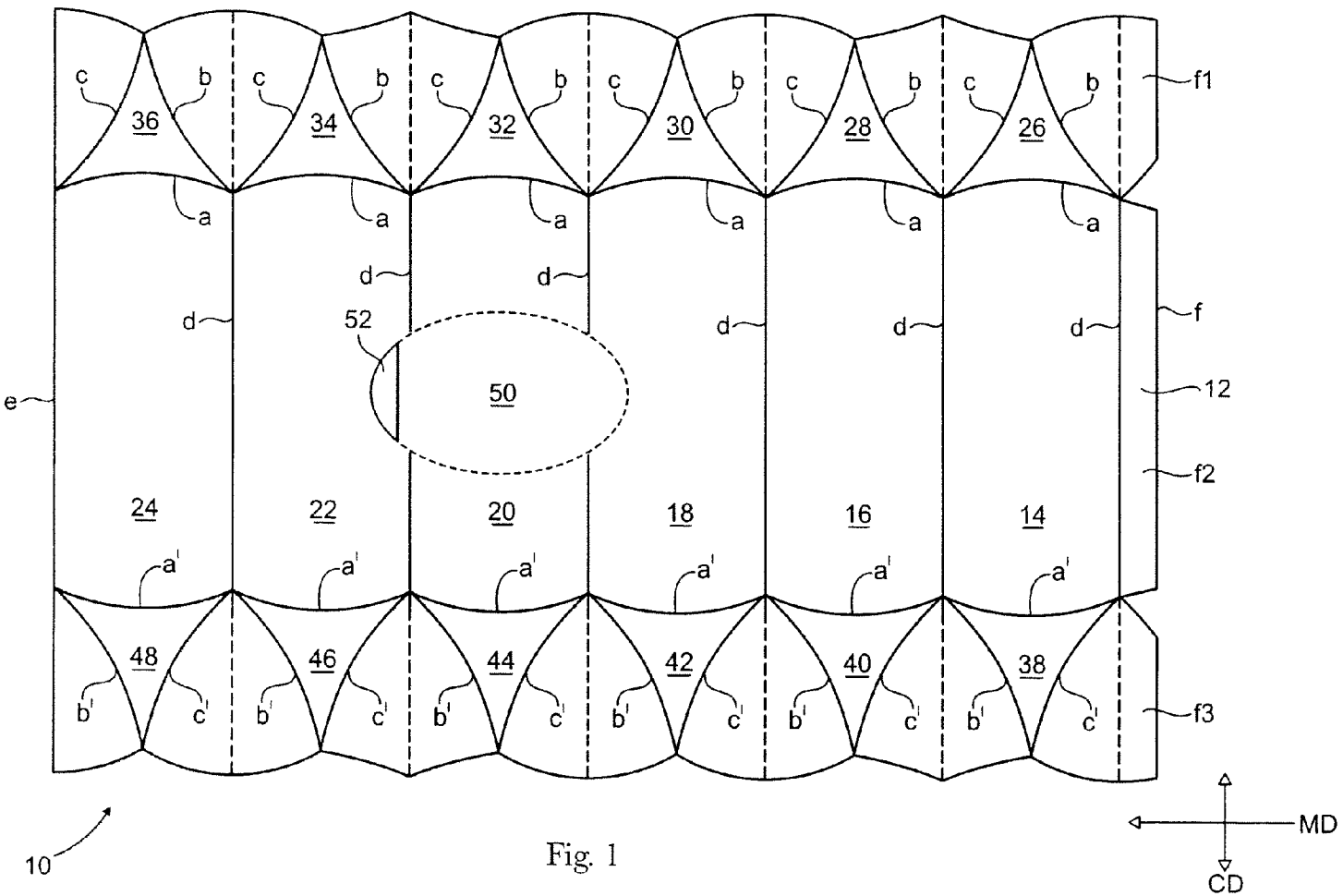
FIG. 1 is a plan view of an exemplary blank for a paper package.

FIG. 1 shows an unfolded carton blank 10 of one embodiment of the present invention. The body portion and the end walls forming a proper and complete container may be assembled from a single carton blank 10. The carton blank 10 is preferably formed from a paperboard material which has been suitably cut and scored as shown. It should be understood that a container having at least three side walls can be formed in accordance with the present disclosure. However, one of skill in the art would readily appreciate that a container having at least six side walls can be formed in a similar manner in accordance with the present disclosure.

As shown, the unfolded carton blank 10 is provided with a plurality of parallel extending score lines d defining a plurality of body panel portions. As shown, each of the plurality of parallel extending score lines d are parallel to the CD. However, the plurality of parallel extending score lines d can be oriented in any direction necessary to form each of the body panel portions shown. In the exemplary embodiment shown, carton blank 10 is provided with five parallel extending score lines d. Each body panel is bounded by an adjacent pair of the parallel extending score lines d. Thus, a first pair of parallel extending score lines d form first body panel 14. A second pair of parallel extending score lines d form second body panel 16. Likewise a third 18, fourth 20, fifth 22, and sixth body panel 24 are formed by succeeding adjacent parallel extending score lines d with sixth body panel 24 having left side edge e forming the outer edge of the panel. However, one of skill in the art will realize that any number of parallel extending score lines d can be provided so as to obtain a resulting container having a cross-section of any desired arcuate or polygonal contour. The parallel extending score lines d are preferably disposed generally parallel to the CD. In the embodiment shown, each of the body panels 14, 16, 18, 20, 22, 24 are disposed collectively elongate in the MD.

Disposed adjacent to each body panel 14, 16, 18, 20, 22, 24 of carton blank 10 are a pair of side panels. In the embodiment shown, a first side panel of a particular body panel is disposed at a first end of the body panel on the longitudinal axis (e.g., in the embodiment shown along the CD) of the body panel. A second side panel is disposed on the longitudinal axis of the body panel and distal from the first side panel. Each side panel could be defined as an extension of the respective body panel and defining the CD edge of the respective body panel.

In other words, each side panel is bounded by extensions of the parallel extending score lines d, the top and bottom MD edges forming the boundaries of carton blank 10, and arcuate score lines a, a' that are disposed generally parallel to the MD and extend archingly across each body panel forming carton blank 10. By way of non limiting example, first side panel 26 and seventh side panel 38 are disposed upon distal CD ends of first body panel 14. Naturally, second side panel 28 and eighth side panel 40 are disposed upon distal ends of second body panel 16, third side panel 30 and ninth side panel 42 are disposed upon distal ends of third body panel 18, fourth side panel 32 and tenth side panel 44 are disposed upon distal ends of fourth body panel 20, fifth side panel 34 and eleventh side panel 46 are disposed upon distal ends of fifth body panel 22, and sixth side panel 36 and twelfth side panel 48 are disposed upon distal ends of sixth body panel 24. Each side panel is bounded and separated from the corresponding body panel by an arcuate score line a, a'.

Figure 2:
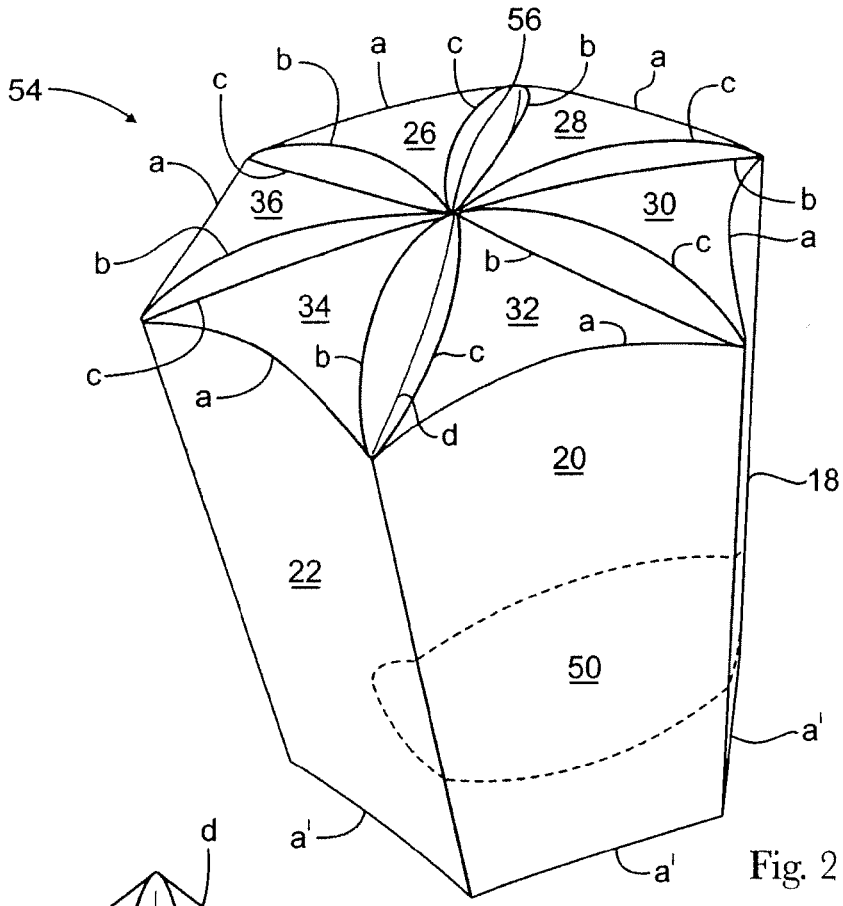
FIG. 2 is a perspective view of an exemplary container formed from the blank of FIG. 1.

It was surprisingly found that each arcuate score line a, a' facilitates a Z-direction rotation (i.e., a rotation out of the MD/CD plane of the carton blank 10) of each side panel 26, 28, 30, 32, 34, 36/38, 40, 42, 44, 46, 48 about an axis formed by the arcuate score line a, a' from the corresponding body panel 14, 16, 18, 20, 22, 24. As can be seen in FIG. 2, rotation provides the two ends of the resulting container 54 formed by adjacent side panels 26, 28, 30, 32, 34, 36/38, 40, 42, 44, 46, 48 to fold nearly flat (i.e. substantially planar or even planar). Having two ends of the resulting container 54 formed by adjacent side panels 26, 28, 30, 32, 34, 36/38, 40, 42, 44, 46, 48 that can fold essentially flat facilitates the packaging of multiple resulting containers 54 as well as facilitating the ability to provide adjacent resulting containers 54 in a closest-packing orientation that maximizes the number of resulting containers 54 in a given amount of shelf space.

Returning again to FIG. 1, top and bottom edges of the carton blank 10 include outwardly rounded edges (or segments) with quasi-alternating linear edges (or segments). Left side edge e and right side edge f are vertical and straight and parallel with the CD. Edge f is interrupted by shapes that form three closure tabs: first closure tab f1, second closure tab f2, and third closure tab f3. When forming the resulting container 54, first closure tab f1, second closure tab f2, and third closure tab f3 can be adhered to body panel 22 proximate to edge e by any means known to those of skill in the art. When first closure tab f1, second closure tab f2, and third closure tab f3 are adhered to body panel 22, it was found suitable to provide an additional score line g that facilitates folding of the edge-adhered carton blank 10 into a flattened condition for shipping due to the odd number of body panels used to form resulting container 54.

A plurality of arch-shaped fold lines (b/c and b'/c') are arranged along both edges with the arch-shaped fold lines along the bottom (b'/c') of carton blank 10 being symmetrical with the arch-shaped fold lines disposed along the top (b/c) of carton blank 10. Preferably, the arch-shaped fold lines along the bottom (b'/c') of carton blank 10 are aligned with the arch-shaped fold lines along the top (b/c) of carton blank 10. The arches are arranged side-by-side and the arch-shaped fold lines (b/c and b'/c') which represent the sides of the arches terminate along each edge at a valley disposed between adjacent arches formed by the outwardly rounded edges and quasi-alternating linear edges. Each arch shaped fold line (b/c and b'/c') terminates at a vertex formed by the intersection of the extensions of the parallel extending score lines d and arcuate score lines a, a'. All dotted lines which represent the extensions of the parallel extending score lines d in FIG. 1 are creased in order to aid in the folding of carton blank 10 and the formation of resulting container 54, so that the extensions of the parallel extending score lines d are encouraged to fold in the opposite direction from the arch-shaped fold lines (b/c and b'/c').

The extensions of the parallel extending score lines d may be described more specifically regarding the arch shapes that appear along the top and bottom edges of the carton blank 10 shown in FIG. 1. Extensions of the parallel extending score lines d are each disposed between an apex of an arch shape forming the top and bottom edges of carton blank 10 and the intersection formed by arch shaped fold lines (b/c and b'/c') of adjacent body panels and adjacent arcuate score lines a, a' disposed upon adjacent body panels. While other fold lines may be pre-creased, the extensions of the parallel extending score lines d are preferably perforated to provide an inward bias to the folding of each recess formed by adjacent arcuate score lines a, a' and adjacent arch shaped fold lines b/c, b'/c'. Further clarity will be given to the invention with regard to the arch shapes of carton blank 10 infra.

Figure 3:
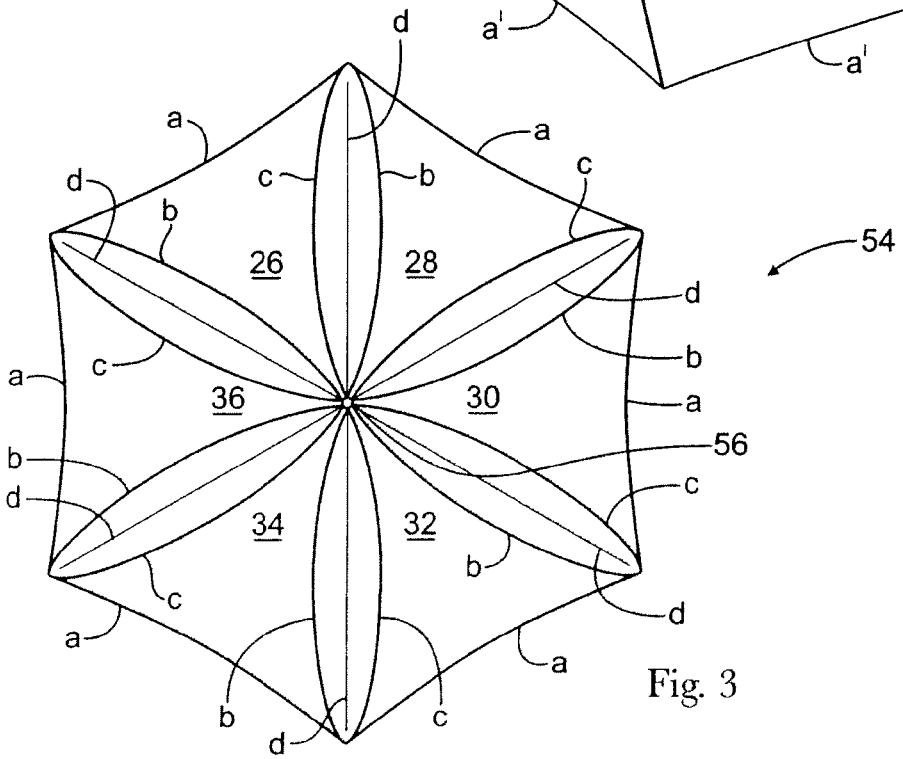
FIG. 3 is a plan view of the top of the exemplary container of FIG. 2.

As shown in FIG. 2 and FIG. 3, the folded resulting container 54 is shown with body panels and side panels disposed in their intended final configuration. As can be seen, one side panel is rotated about an arcuate score line a separating each side panel 26, 28, 30, 32, 34, 36 from the corresponding body panel 14, 16, 18, 20, 22, 24. Concurrently with such rotation, each side panel 26, 28, 30, 32, 34, 36 is folded about corresponding arch-shaped fold lines b, c and forms an apex between adjacent side panels 26, 28, 30, 32, 34, 36 consistent with the extensions of the parallel extending score lines d that separates adjacent body panels 14, 16, 18, 20, 22, 24. As shown, the resulting folds produce an end of resulting container 54 that resembles a plurality of pie-shaped triangular sections that are bounded by arch-shaped fold lines b, c, arcuate score line a, and a portion of the top edge of carton blank 10. Naturally, the bottom portion of carton blank 10 can form an end similar to that described supra to resemble a plurality of pie-shaped triangular sections that are bounded by arch-shaped fold lines b', c', arcuate score line a', and a portion of the bottom edge of carton blank 10.

The finally resulting container 54 can then be closed and held in a closed manner with sealing means 56. The sealing means 56 may comprise any sealing means known to those of skill in the art for retaining relevant portions of the finally formed resulting container 54 in fixed relation to each other. By way of non-limiting example, sealing means 56 may comprise glue disposed at the intersection of all folded side panels, a tape strip disposed upon the surface forming the side of resulting container 54 and contacting each side panel forming the end of resulting container 54, a locking tab that engages at least two portions of the sides forming resulting container 54, and the like. Similarly, tabs can be included upon portions of the top and bottom edges forming carton blank 10. These tabs can then be resultingly disposed in a face-to-face relationship upon the folding described supra that results in the formation of an end of resulting container 54. Depositing an adhesive or other substance upon opposed portions of the tabs can then fixably position each pie-shaped portion of the end of resulting container 54.

As shown in FIGS. 1 and 2, a preferred embodiment of the carton blank 10 forms a resulting container 54 suitable for storing articles therein. Exemplary, but non-liming, articles include consumer products. Such consumer products can be edible or non-edible. Edible consumer products can include candy, snack products, such as snack chips, pretzels, and the like. Non-edible products can include, but are not limited to, tissue products, facial tissues, paper toweling, bath tissue, hardware, combinations thereof, and the like. In order to facilitate removal of products disposed within resulting container 54, access panel 50 may be disposed upon at least one body panel of the carton blank 10. The access panel 50 may be formed by perforations in order to facilitate its removal from the finally formed resulting container 54. One or more finger grip region 52 may be formed in concert with access panel 50 in order to facilitate gripping of the access panel 50 and removal of access panel 50 from resulting container 54.

A plurality of resulting containers 54 can be co-packaged or co-wrapped with other resulting containers 54 to provide for a package containing several resulting containers. This has been found to provide a convenient means for a consumer to obtain several resulting containers 54 containing similar products therein without the inconvenience of having to handle several individual resulting containers 54. Such a co-packaging or co-wrapping execution can use a polymeric film or other suitable bundling means any machinery known to those of skill in the art to bulk wrap several resulting container 54 together.

It should also be realized by one of skill in the art that the resulting container 54 can be creatively decorated with indicium or indicia that coordinate the outer surface of the resulting container defined by body panels 14, 16, 18, 20, 22, 24 with the pie-shaped triangular sections forming the ends of resulting container 54 and being substantially bounded by two of the plurality of straight vertical lines d, d' and one of the second plurality of arch-shaped fold lines a, a'. By way of non-limiting example the container portion defined by body panels 14, 16, 18, 20, 22, 24 could be provided as a representative fruit, cookie, berry, nut, and the like. Accordingly, the pie-shaped triangular sections forming the ends of resulting container 54 could be coordinatingly decorated to represent a portion, or slice, of a pie containing the fruit, cookie, berry, or nut, or can represent a cross-sectional view of the fruit, cookie, berry, or nut. Clearly, there are an innumerable number of suitable coordinated designs for use with the instantly disclosed container. For example, if the resulting container 54 is envisioned to hold candy therein, body panels 14, 16, 18, 20, 22, 24 could be decorated with a design representing a perspective view of a jar containing the candy. The pie-shaped triangular sections forming the ends of resulting container 54 could be designed to represent a cross-sectional view of such a container.

Figure 4:
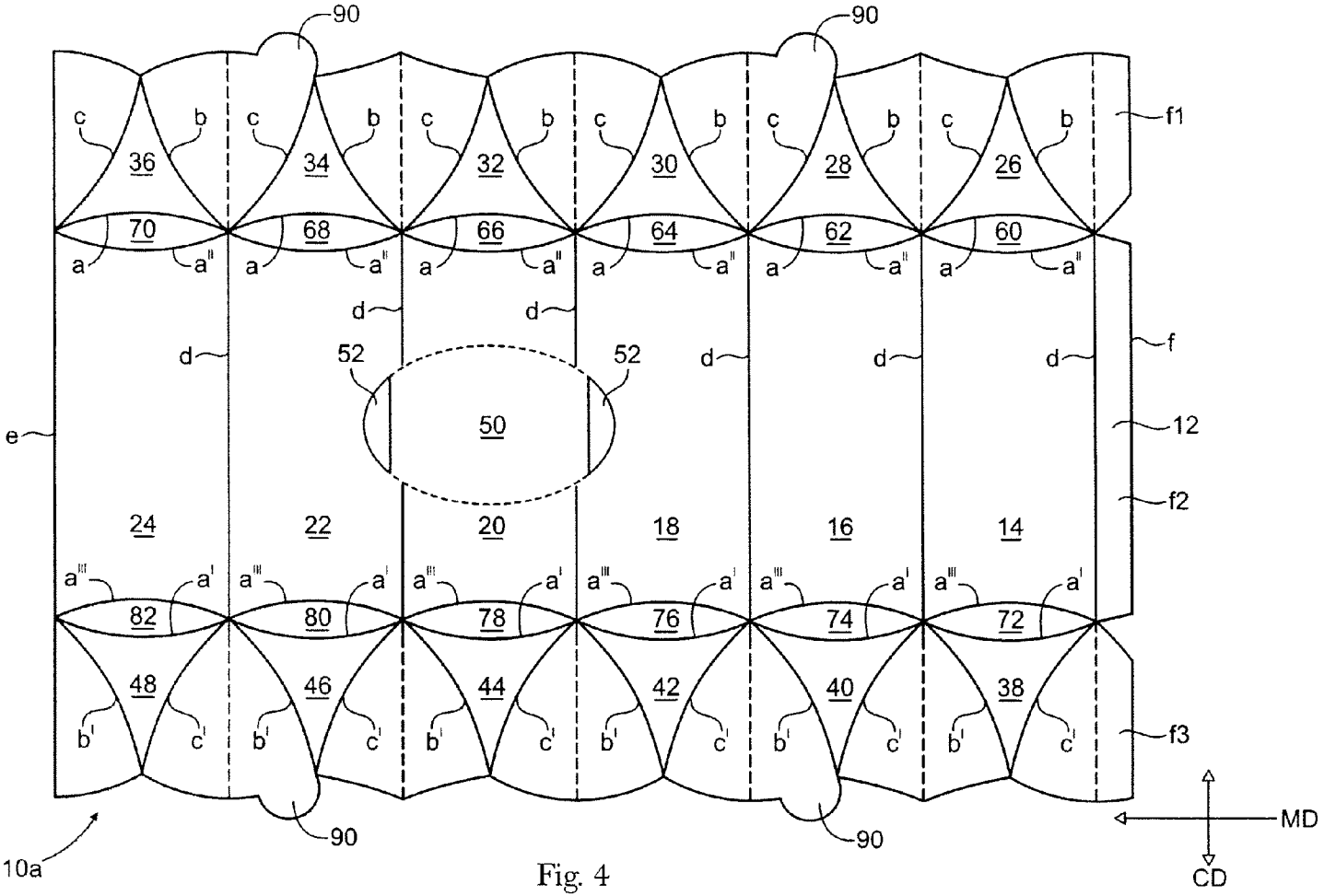
FIG. 4 is a plan view of an exemplary blank for a paper package.

FIG. 4 shows an unfolded carton blank 10*a* of one embodiment of the present invention. The body portion and the end walls forming a proper and complete container may be assembled from a single carton blank 10*a*. The carton blank 10*a* is preferably formed from a paperboard material which has been suitably cut and scored as shown. It should be understood that a container having at least three side walls can be formed in accordance with the present disclosure. However, one of skill in the art would readily appreciate that a container having at least six side walls can be formed in a similar manner in accordance with the present disclosure.

As shown, the unfolded carton blank 10*a* is provided with a plurality of parallel extending score lines d defining a plurality of adjacent body panel portions. As shown, each of the plurality of parallel extending score lines d are parallel to the CD. However, the plurality of parallel extending score lines d can be oriented in any direction necessary to form each of the body panel portions shown. In the exemplary embodiment shown, carton blank 10*a* is provided with five parallel extending score lines d. Each body panel is bounded by an adjacent pair of the parallel extending score lines d. Thus, a first pair of parallel extending score lines d form first body panel 14. A second pair of parallel extending score lines d form second body panel 16. Likewise a third body panel 18, fourth body panel 20, fifth body panel 22, and sixth body panel 24 are formed by succeeding adjacent parallel extending score lines d with sixth body panel 24 having left side edge e forming the outer edge of the panel. However, one of skill in the art will realize that any number of parallel extending score lines d can be provided so as to obtain a resulting container having a cross-section of any desired arcuate or polygonal contour. The parallel extending score lines d are preferably disposed generally parallel to the CD. In the embodiment shown, each of the body panels 14, 16, 18, 20, 22, 24 are disposed to be collectively elongate in the MD.

Disposed adjacent to each body panel 14, 16, 18, 20, 22, 24 of carton blank 10*a* are a pair of side panels. In the embodiment shown, a first side panel of a particular body panel is disposed at a first end of a body panel on the longitudinal axis (e.g., in the embodiment shown along the CD) of the body panel. A second side panel is disposed on the longitudinal axis of the body panel distal from the first side panel. Each side panel could be defined as an extension of the respective body panel and defining the CD edge of the respective body panel bounded by corresponding parallel extending score lines d.

In other words, each side panel is bounded by extensions of the parallel extending score lines d, the top and bottom MD edges forming the boundaries of carton blank 10*a*, and arcuate score lines a/a", a'/a'" that are disposed generally parallel to the MD and extend archingly across each body panel forming carton blank 10. By way of non-limiting example, first side panel 26 and seventh side panel 38 are disposed upon distal CD ends of first body panel 14. Naturally, second side panel 28 and eighth side panel 40 are correspondingly disposed upon distal ends of second body panel 16, third side panel 30 and ninth side panel 42 are correspondingly disposed upon distal ends of third body panel 18, fourth side panel 32 and tenth side panel 44 are correspondingly disposed upon distal ends of fourth body panel 20, fifth side panel 34 and eleventh side panel 46 are correspondingly disposed upon distal ends of fifth body panel 22, and sixth side panel 36 and twelfth side panel 48 are correspondingly disposed upon distal ends of sixth body panel 24.

Each side panel 26, 28, 30, 32, 34, 36, 38, 40, 42, 44, 46, 48 is bounded and separated from the corresponding body panel 14, 16, 18, 20, 22, 24 by corresponding regions 60, 62, 64, 66, 68, 70, 72, 74, 76, 78, 80, 82 that are each bounded by pairs of corresponding arcuate score lines a/a", a'/a'". In other words, one of skill in the art will realize that carton blank 10*a* is provided with a first plurality of side panels 26, 28, 30, 32, 34, 36 disposed adjacent and corresponding body panels 14, 16, 18, 20, 22, 24 and separated by corresponding regions 60, 62, 64, 66, 68, 70 bounded by corresponding arcuate score lines a, a" and a second plurality of side panels 38, 40, 42, 44, 46, 48 are separated from corresponding body panels 14, 16, 18, 20, 22, 24 and separated by corresponding regions 72, 74, 76, 78, 80, 82 bounded by corresponding arcuate score lines a', a'".

It was surprisingly found that each region 60, 62, 64, 66, 68, 70, 72, 74, 76, 78, 80, 82 bounded by corresponding arcuate score lines a/a", a'/a'" can facilitate a Z-direction rotation (i.e., a rotation out of the MD/CD plane of the carton blank 10*a*) of each side panel 26, 28, 30, 32, 34, 36, 38, 40, 42, 44, 46, 48 about an axis formed generally parallel to the longitudinal axis of reach region 60, 62, 64, 66, 68, 70, 72, 74, 76, 78, 80, 82 bounded by corresponding arcuate score lines a/a", a'/a'" from the corresponding body panel 14, 16, 18, 20, 22, 24.

Figure 5:
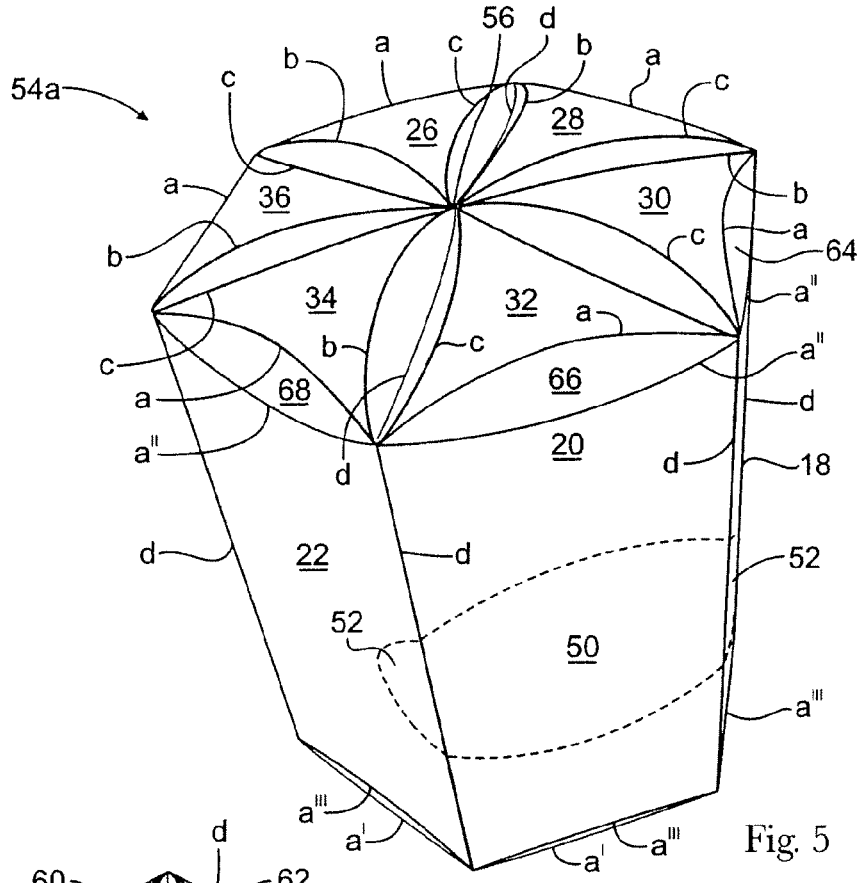
FIG. 5 is a perspective view of an exemplary container formed from the blank of FIG. 4.
Figure 6:
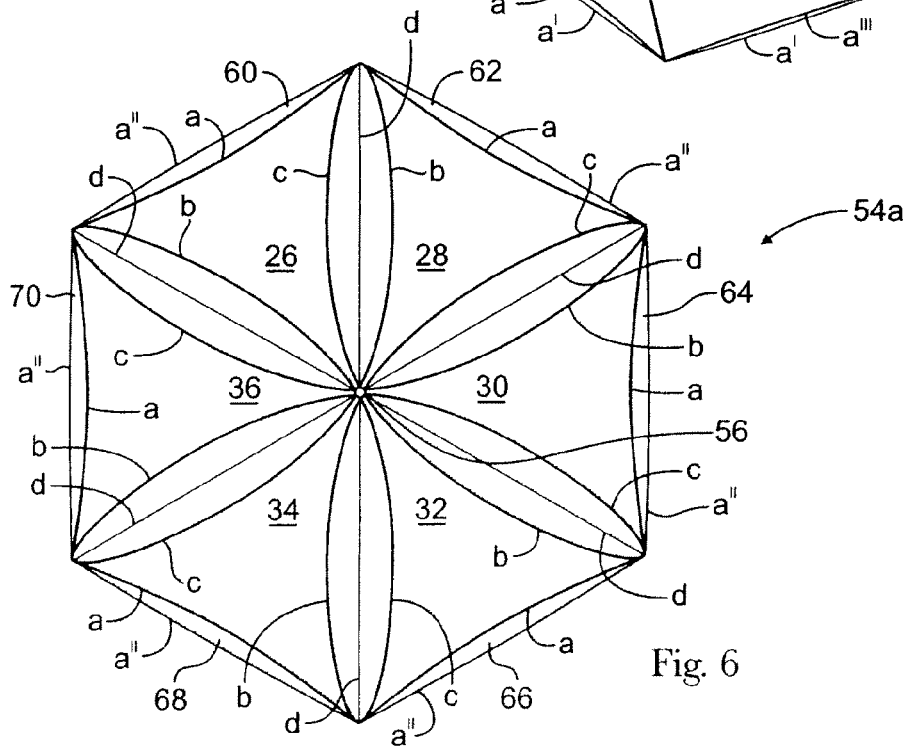
FIG. 6 is a plan view of the top of the exemplary container of FIG. 5.

As can be seen in FIGS. 5 and 6, rotation out of the MD/CD plane by side panels 26, 28, 30, 32, 34, 36 rotation when edge f is adhered to edge e provides the ends of the resulting container 54*a* formed by adjacent side panels 26, 28, 30, 32, 34, 36/38, 40, 42, 44, 46, 48 to fold nearly flat (i.e. substantially planar or even planar). Having an end of the resulting container 54*a* formed by corresponding adjacent side panels 26, 28, 30, 32, 34, 36/38, 40, 42, 44, 46, 48 that can fold essentially flat facilitates the packaging of multiple resulting containers 54*a* as well as facilitating the ability to provide adjacent resulting containers 54*a* in a closest-packing orientation that maximizes the number of resulting containers 54*a* in a given amount of shelf space.

It was surprisingly found that providing carton blank 10*a* with regions 60, 62, 64, 66, 68, 70, 72, 74, 76, 78, 80, 82 bounded by corresponding arcuate score lines a/a", a'/a'" can minimize any effects resulting from the rotation of each side panel 26, 28, 30, 32, 34, 36/38, 40, 42, 44, 46, 46 to about an axis formed generally parallel to the longitudinal axis of each region 60, 62, 64, 66, 68, 70, 72, 74, 76, 78, 80, 82 bounded by corresponding arcuate score lines a/a", a'/a'" from the corresponding body panel 14, 16, 18, 20, 22, 24. It is believed that such rotation may cause the material comprising carton blank 10*a* to deform or even buckle in the area proximate to the rotation due to induced material stresses. Such deformation in the container 54*a* can negatively impact the perception of the container 54*a* by a consumer desiring to purchase a container 54*a* containing an article of manufacture. Defects in the packaging of articles of manufacture are known to cause consumers to believe that defective packaging can imply that the article of manufacture is also damaged or poorly manufactured. Additionally, having two ends of the resulting container 54*a* formed by adjacent side panels 26, 28, 30, 32, 34, 36/38, 40, 42, 44, 46, 48 that can fold essentially flat facilitates the packaging of multiple resulting containers 54*a* as well as facilitating the ability to provide adjacent resulting containers 54*a* in a closest-packing orientation that maximizes the number of resulting containers 54*a* in a given amount of shelf space.

Returning again to FIG. 4, top and bottom edges of the carton blank 10*a* include outwardly rounded edges (or segments) with quasi-alternating linear edges (or segments). Left side edge e and right side edge f are vertical and straight and parallel with the CD. Edge f is interrupted by shapes that form three closure tabs: first closure tab f1, second closure tab f2, and third closure tab f3. When forming the resulting container 54*a*, first closure tab f1, second closure tab f2, and third closure tab 13 can be adhered to body panel 22 proximate to edge e by any means known to those of skill in the art. When first closure tab f1, second closure tab 12, and third closure tab 13 are adhered to body panel 22, it was found suitable to provide an additional score line g that facilitates folding of the edge-adhered carton blank 10*a* into a flattened condition for shipping due to the odd number of body panels used to form resulting container 54*a*.

A plurality of arch-shaped fold lines (b/c and b'/c') are arranged along both edges with the arch-shaped fold lines along the bottom (b'/c') of carton blank 10*a* being symmetrical with the arch-shaped fold lines disposed along the top (b/c) of carton blank 10*a*. Preferably, the arch-shaped fold lines along the bottom (b'/c') of carton blank 10*a* are aligned with the arch-shaped fold lines along the top (b/c) of carton blank 10*a*. The arches are arranged side-by-side and the arch-shaped fold lines (b/c and b'/c') which represent the sides of the arches terminate along each edge at a valley disposed between adjacent arches formed by the outwardly rounded edges and quasi-alternating linear edges. Each arch shaped fold line (b/c and b'/c') terminates at a vertex formed by the intersection of the extensions of the parallel extending score lines d and arcuate score lines a/a", a'/a'". All dotted lines which represent the extensions of the parallel extending score lines d in FIG. 4 are creased in order to aid in the folding of carton blank 10*a* and the formation of resulting container 54*a*, so that the extensions of the parallel extending score lines d are encouraged to fold in the opposite direction from the arch-shaped fold lines (b/c and b'/c').

The extensions of the parallel extending score lines d may be described more specifically regarding the arch shapes that appear along the top and bottom edges of the carton blank 10*a* shown in FIG. 4. Extensions of the parallel extending score lines d are each disposed between an apex of an arch shape forming the top and bottom edges of carton blank 10*a* and the intersection formed by arch shaped fold lines (b/c and b'/c') of adjacent body panels and adjacent corresponding arcuate score lines a/a", a'/a'" disposed upon adjacent body panels. While other fold lines may be pre-creased, the extensions of the parallel extending score lines d are preferably perforated to provide an inward bias to the folding of each recess formed by adjacent corresponding arcuate score lines a/a", a'/a'" and adjacent arch shaped fold lines b/c, b'/c'. Further clarity will be given to the invention with regard to the arch shapes of carton blank 10*a* infra.

As shown in FIGS. 5 and 6, the folded resulting container 54*a* is shown with body panels and side panels disposed in their intended final configuration. As can be seen, one side panel is rotated about an arcuate score line a separating each side panel 26, 28, 30, 32, 34, 36 from the corresponding body panel 14, 16, 18, 20, 22, 24. Concurrently with such rotation, each side panel 26, 28, 30, 32, 34, 36 is folded about corresponding arch-shaped fold lines b, c and forms an apex between adjacent side panels 26, 28, 30, 32, 34, 36 consistent with the extensions of the parallel extending score lines d that separates adjacent body panels 14, 16, 18, 20, 22, 24. As shown, the resulting folds produce an end of resulting container 54*a* that resembles a plurality of pie-shaped triangular sections that are bounded by arch-shaped fold lines b, c, arcuate score line a, and a portion of the top edge of carton blank 10*a*. Naturally, the bottom portion of carton blank 10*a* can form an end similar to that described supra to resemble a plurality of pie-shaped triangular sections that are bounded by arch-shaped fold lines b', c', arcuate score line a', and a portion of the bottom edge of carton blank 10*a*.

The finally resulting container 54*a* can then be closed and held in a closed manner with sealing means 56. The sealing means 56 may comprise any sealing means known to those of skill in the art for retaining relevant portions of the finally formed resulting container 54*a* in fixed relation to each other. By way of non-limiting example, sealing means 56 may comprise glue disposed at the intersection of all folded side panels, a tape strip disposed upon the surface forming the side of resulting container 54*a* and contacting each side panel forming the end of resulting container 54*a*, a locking tab 90 that engages at least two portions of the sides forming resulting container 54*a*, and the like. Similarly, locking tabs 90 can be included upon portions of the top and bottom edges forming carton blank 10*a*. These tabs can then be resultingly disposed in a face-to-face relationship upon the folding described supra that results in the formation of an end of resulting container 54*a*. Depositing an adhesive or other substance upon opposed portions of the tabs can then fixably position each pie-shaped portion of the end of resulting container 54*a*.

As shown in FIGS. 4-6, a preferred embodiment of the carton blank 10*a* forms a resulting container 54*a* suitable for storing articles therein. Exemplary, but non-liming, articles include consumer products. Such consumer products can be edible or non-edible. Edible consumer products can include candy, snack products, such as snack chips, pretzels, and the like. Non-edible products can include, but are not limited to, tissue products, facial tissues, paper toweling, bath tissue, hardware, combinations thereof, and the like. In order to facilitate removal of products disposed within resulting container 54*a*, access panel 50 may be disposed upon at least one body panel of the carton blank 10. The access panel 50 may be formed by perforations in order to facilitate its removal from the finally formed resulting container 54*a*. One or more finger grip region 52 may be formed in concert with access panel 50 in order to facilitate gripping of the access panel 50 and removal of access panel 50 from resulting container 54*a*.

A plurality of resulting containers 54*a* can be co-packaged or co-wrapped with other resulting containers 54*a* to provide for a package containing several resulting containers. This has been found to provide a convenient means for a consumer to obtain several resulting containers 54*a* containing similar products therein without the inconvenience of having to handle several individual resulting containers 54*a*. Such a co-packaging or co-wrapping execution can use a polymeric film or other suitable bundling means any machinery known to those of skill in the art to bulk wrap several resulting container 54*a* together.

As discussed supra, it should also be realized by one of skill in the art that the resulting container 54*a* can be creatively decorated with indicium or indicia that coordinate the outer surface of the resulting container defined by body panels 14, 16, 18, 20, 22, 24 with the pie-shaped triangular sections forming the ends of resulting container 54*a* and being substantially bounded by two of the plurality of straight vertical lines d, d' and one of the second plurality of arch-shaped fold lines a, a'. By way of non-limiting example the container portion defined by body panels 14, 16, 18, 20, 22, 24 could be provided as a representative fruit, cookie, berry, nut, and the like. Accordingly, the pie-shaped triangular sections forming the ends of resulting container 54*a* could be coordinatingly decorated to represent a portion, or slice, of a pie containing the fruit, cookie, berry, or nut, or can represent a cross-sectional view of the fruit, cookie, berry, or nut. Clearly, there are an innumerable number of suitable coordinated designs for use with the instantly disclosed container. For example, if the resulting container 54 is envisioned to hold candy therein, body panels 14, 16, 18, 20, 22, 24 could be decorated with a design representing a perspective view of a jar containing the candy. The pie-shaped triangular sections forming the ends of resulting container 54*a* could be designed to represent a cross-sectional view of such a container.

Figure 7:
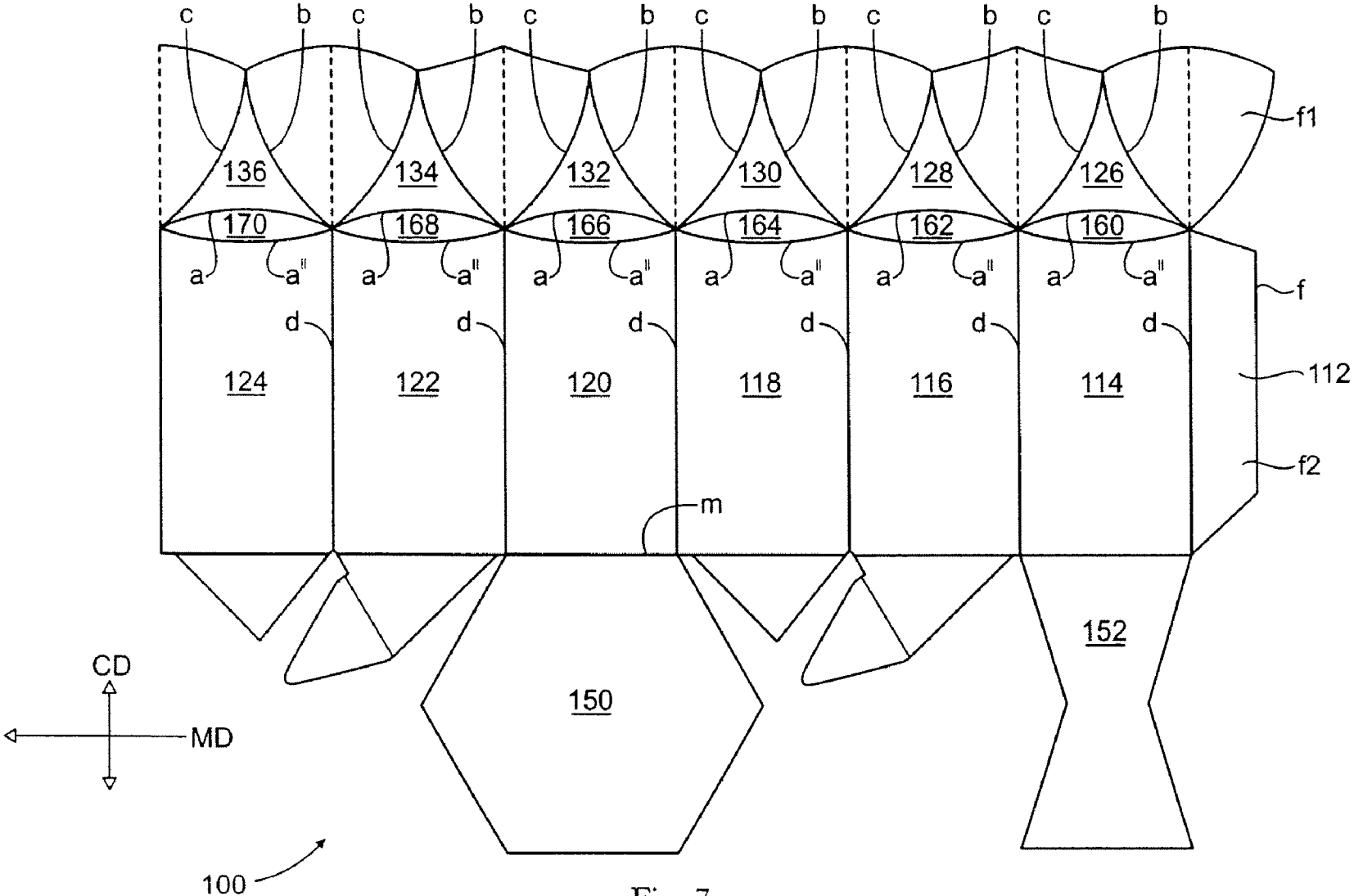
FIG. 7 is a plan view of another embodiment of an exemplary blank for a paper package.
Figure 8:
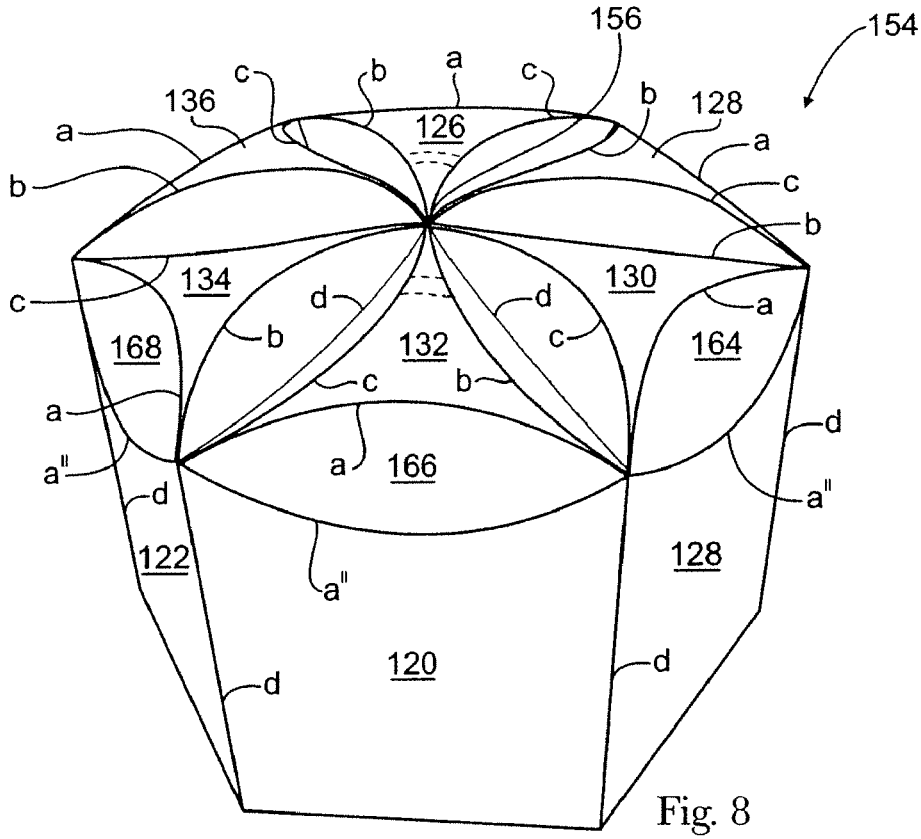
FIG. 8 is a perspective view of an exemplary container formed from the blank of FIG. 7.
Figure 9:
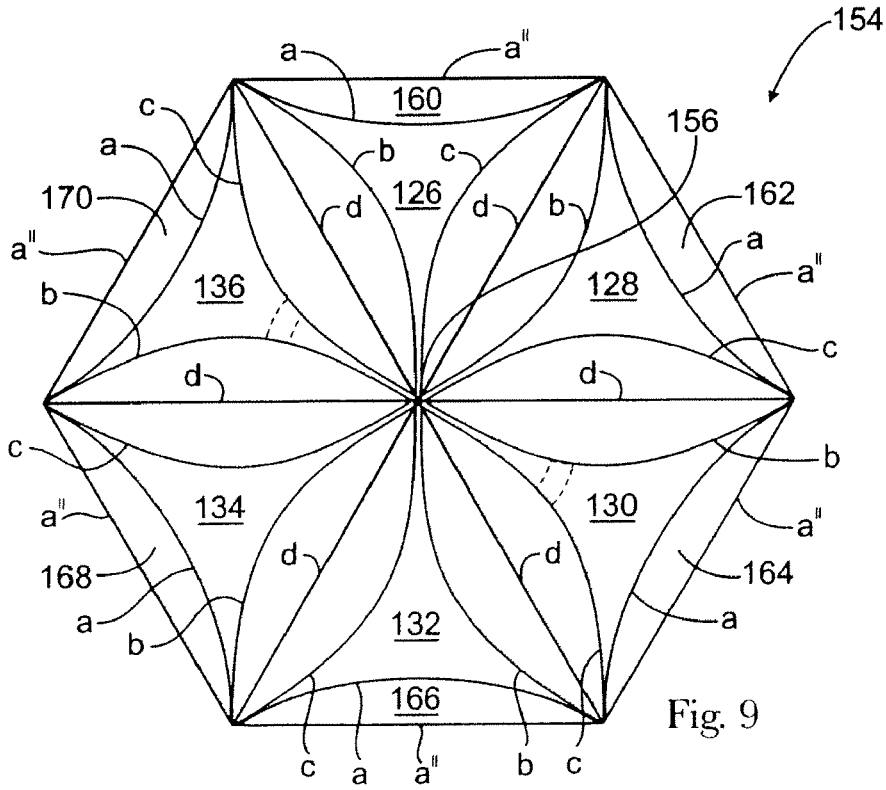
FIG. 9 is a plan view of the top of the exemplary container of FIG. 8.

FIGS. 7-9 provide an alternative embodiment for the present invention. The body portion and the end walls forming a container 154 proper may be assembled from a single carton blank 100 of paperboard material which has been suitably cut and scored as shown. It should be understood that a container having at least three side walls can be produced from the disclosure of the present embodiment. However, it is preferred that a container 154 is preferably provided with at least five side walls. A yet more preferred embodiment of a container 154 is provided with at least six side walls.

As shown, the unfolded carton blank 100 is provided with a plurality of parallel extending score lines d defining body panel segments. Each of the plurality of parallel extending score lines d are parallel to the CD. However, the plurality of parallel extending score lines d can be oriented in any direction necessary to form each of the body panel portions shown. In the exemplary embodiment shown, carton blank 10 is provided with five parallel extending score lines d. Each body panel is bounded by an adjacent pair of the parallel extending score lines d. Thus, a first pair of parallel extending score lines d form first body panel 114. A second pair of parallel extending score lines d form second body panel 116. Likewise a third 118, fourth 120, fifth 122, and sixth body panel 124 are formed by succeeding adjacent parallel extending score lines d with sixth body panel 124 having left side edge e forming the outer edge of the panel. However, one of skill in the art will realize that any number of parallel extending score lines d can be provided so as to obtain a resulting container having a cross-section of any desired arcuate or polygonal contour. The parallel extending score lines d are preferably disposed generally parallel to the CD. In the embodiment shown, each of the body panels 114, 116, 118, 120, 122, 124 are disposed collectively elongate in the MD.

In a preferred embodiment side panels are disposed adjacent to each body panel 114, 116, 118, 120, 122, 124 of carton blank 100. In the embodiment shown, a first side panel of a particular body panel is disposed at a first end of the body panel on the longitudinal axis (e.g., in the embodiment shown along the CD) of the body panel. If so desired, one of skill in the art will realize that a second side panel can be disposed on the longitudinal axis of the body panel and distal from the first side panel. Each side panel could be defined as an extension of the respective body panel and defining the CD edge of the respective body panel.

In other words, each side panel is bounded by extensions of the parallel extending score lines d, the top and bottom MD edges forming the boundaries of carton blank 10, and arcuate score lines a that are disposed generally parallel to the MD and extend archingly across each body panel forming carton blank 100. By way of non-limiting example, first side panel 126 is disposed upon one end of first body panel 114. Naturally, second side panel 128 is disposed upon one end of second body panel 116 adjacent first side panel 126, third side panel 130 is disposed upon one end of third body panel 118 adjacent second side panel 128, fourth side panel 132 is disposed upon one end of fourth body panel 120 adjacent third side panel 130, fifth side panel 134 is disposed upon one end of fifth body panel 122 adjacent fourth side panel 134, and sixth side panel 136 and is disposed upon one end of sixth body panel 124 adjacent fifth side panel 134. Each side panel 126, 128, 130, 132, 134, 136 is bounded and separated from the corresponding body panel 114, 116, 118, 120, 122, 124 by regions 160, 162, 164, 166, 168, 170 that are each bounded by arcuate score lines a, a". One of skill in the art will realize that if carton blank 100 is provided with a second plurality of side panels (not shown) disposed adjacent body panels 114, 116, 118, 120, 122, 124 and distal side panels 126, 128, 130, 132, 134, 136, the second plurality of side panels (not shown) may also be separated from body panels 114, 116, 118, 120, 122, 124 by regions bounded by corresponding arcuate score lines a, a".

It was surprisingly found that each region 160, 162, 164, 166, 168, 170 bounded by arcuate score lines a, a" can facilitate a Z-direction rotation (i.e., a rotation out of the MD/CD plane of the carton blank 10) of each side panel 126, 128, 130, 132, 134, 136 about an axis formed generally parallel to the longitudinal axis of reach region 160, 162, 164, 166, 168, 170 bounded by the arcuate score lines a, a" from the corresponding body panel 114, 116, 118, 120, 122, 124. As can be seen in FIG. 8, rotation out of the MD/CD plane by side panels 126, 128, 130, 132, 134, 136 rotation when edge f is adhered to edge e provides the end (or ends if side panels are provided on distal ends of each body panel 114, 116, 118, 120, 122, 124) of the resulting container 154 formed by adjacent side panels 126, 128, 130, 132, 134, 136 to fold nearly flat (i.e. substantially planar or even planar). Having an end of the resulting container 154 formed by adjacent side panels 126, 128, 130, 132, 134, 136 that can fold essentially flat facilitates the packaging of multiple resulting containers 154 as well as facilitating the ability to provide adjacent resulting containers 154 in a closest-packing orientation that maximizes the number of resulting containers 154 in a given amount of shelf space.

It was surprisingly found that providing carton blank 100 with regions 160, 162, 164, 166, 168, 170 bounded by the arcuate score lines a, a" can minimize any effects resulting from the rotation of each side panel 126, 128, 130, 132, 134, 136 about an axis formed generally parallel to the longitudinal axis of reach region 160, 162, 164, 166, 168, 170 bounded by the arcuate score lines a, a" from the corresponding body panel 114, 116, 118, 120, 122, 124. It is believed that such rotation may cause the material comprising carton blank 100 to deform or even buckle in the area proximate to the rotation due to induced material stresses. Such deformation in the container 154 can negatively impact the perception of the container 154 by a consumer desiring to purchase a container 154 containing an article of manufacture. Defects in the packaging of articles of manufacture are known to cause consumers to believe that defective packaging can imply that the article of manufacture is also damaged or poorly manufactured.

The top edge of the carton blank 100 includes outwardly rounded edges with quasi-alternating linear edges. Left side edge e and right side edge f are vertical and straight. Edge f is interrupted by shapes that form two closure tabs: first closure tab f1 and second closure tab f2.

A plurality of arch-shaped fold lines (b/c) are arranged along the top edge (or along both edges if a plurality of side panels are disposed adjacent body panels 114, 116, 118, 120, 122, 124 and distal side panels 126, 128, 130, 132, 134, 136). In an embodiment where side panels are disposed upon distal ends of body panels 114, 116, 118, 120, 122, 124 the arch-shaped fold lines provided along the bottom edge of carton blank 100 should be provided to be symmetrical and aligned with the arch-shaped fold lines b/c disposed along the top of carton blank 100.

Preferably, the arches formed by arch-shaped fold lines b/c are arranged to be side-by-side. Further, the arch-shaped fold lines b/c which represent the sides of the arches terminate along each edge at a valley disposed between adjacent arches formed by the outwardly rounded edges and quasi-alternating linear edges. Each arch shaped fold line b/c terminates at a vertex formed by the intersection of the extensions of the parallel extending score lines d and arcuate score lines a. All dotted lines which represent the extensions of the parallel extending score lines d in FIG. 7 are creased in order to aid in the folding of carton blank 100 and the formation of resulting container 154, so that the extensions of the parallel extending score lines d are encouraged to fold in the opposite direction from the arch-shaped fold lines b/c.

The extensions of the parallel extending score lines d may be described more specifically regarding the arch shapes that appear along the top and bottom edges of the carton blank 100 shown in FIG. 7. Extensions of the parallel extending score lines d are each disposed between an apex of an arch shape forming the top and bottom edges of carton blank 100 and the intersection formed by arch shaped fold lines b/c of adjacent body panels and adjacent arcuate score lines a disposed upon adjacent body panels. While other fold lines may be precreased, the extensions of the parallel extending score lines d are preferably perforated to provide an inward bias to the folding of each recess formed by adjacent arcuate score lines a and adjacent arch shaped fold lines b/c. Further clarity will be given to the invention with regard to the arch shapes of carton blank 100 infra.

As shown in FIG. 8 and FIG. 9, the folded resulting container 154 is shown with body panels 114, 116, 118, 120, 122, 124 and side panels 126, 128, 130, 132, 134, 136 disposed in their intended final configuration. As can be seen, one side panel is rotated about an axis comprising arcuate score lines a, a" forming regions 160, 162, 164, 166, 168, 170 that separate each side panel 126, 18, 130, 132, 134, 136 from the corresponding body panel 114, 116, 118, 120, 122, 124. Concurrently with such rotation, each side panel 126, 128, 130, 132, 134, 136 is folded about corresponding arch-shaped fold lines b, c and forms an apex between adjacent side panels 126, 128, 130, 132, 134, 136 consistent with the extensions of the parallel extending score lines d that separates adjacent body panels 114, 116, 118, 120, 122, 124. As shown, the resulting folds produce an end of resulting container 154 that resembles a plurality of pie-shaped triangular sections that are bounded by arch-shaped fold lines b, c, arcuate score line a, and a portion of the top edge of carton blank 100. Regions 160, 162, 164, 166, 168, 170 bounded by arcuate score lines a, a" form a plurality of facets disposed upon container 154. Naturally, the bottom portion of carton blank 100 can form an end similar to that described supra to resemble a plurality of pie-shaped triangular sections that are bounded by arch-shaped fold lines, an arcuate score line, and a portion of the bottom edge of carton blank 100.

The finally resulting container 154 can then be closed and held in a closed manner with sealing means 156 described supra. Alternatively, no sealing means may be disposed upon container 154. Access to the contents disposed within container 154 can be achieved by reversibly opening and closing the side panel of container 154 formed by the plurality of pie-shaped triangular sections fold lines, an arcuate score line, and a portion of the bottom edge of carton blank 100. In this instance, the side panel would be opened by rotating the components forming the side panel of container 154 (i.e., side panels 126, 128, 130, 132, 134, 136 and regions 160, 162, 164, 166, 168, 170 back into plane with the corresponding body panel 114, 116, 118, 120, 122, 124.

Alternatively, an access panel (not shown) may (not shown) may be formed by perforations in order to facilitate its removal from the finally formed resulting container 154. One or more finger grip regions (not shown) may be formed in concert with access panel (not shown) in order to facilitate gripping of the access panel (not shown) and removal of access panel (not shown) from resulting container 154. Further, a plurality of resulting containers 154 can be co-packaged or co-wrapped with other resulting containers 154 to provide for a package containing several resulting containers as discussed supra. Additionally, the resulting container 154 can be creatively decorated with indicium or indicia as described supra.

FIGS. 7-9 provide yet another exemplary unfolded carton blank 200 of another embodiment of the present invention. The body portion and the end walls forming a container proper may be assembled from a single blank of paperboard material which has been suitably cut and scored as shown. It should be understood that a container having at least five side walls and preferably at least six side walls.

The carton blank 200 provides for a plurality of side walls 216, 220, 222, 224, 226, 228 that extend between the top panel 218 and bottom panel 214. Overlapping panels 234, 244 can be adhesively or otherwise mechanically connected to side walls 228 and 220 respectively in order to form a finally foamed container 260. Top panel 218 and bottom panel 214 in the exemplary embodiment are provided in a hexagonal configuration the periphery of which is formed from line segments wherein each line segment corresponds to the ends of a corresponding side panel. By way of example, line segment p disposed on the periphery of top panel 218 and line segment s disposed on the periphery of bottom panel 214 correspond to the top and bottom line segments forming side wall 224. Similarly, line segment q disposed on the periphery of top panel 218 and line segment r disposed on the periphery of bottom panel 214 correspond to the top and bottom line segments forming side wall 216.

When the portions of carton blank 200 separated by the axis comprising line segment p are rotated in the Z-direction about the axis comprising line segment p, corner portions 238, 248 are preferably deflected in the direction of rotation. This is because the corner portions 238, 248 are preferably provided with score lines that traverse the height of an isosceles triangle formed between top portion 218 and one edge forming side wall 226 and sidewall 222 respectively. As the material of carton blank 200 disposed upon one side of the axis comprising line segment p is rotated about the axis comprising line segment p toward the material of carton blank 200 disposed upon the adjacent side of the axis comprising line segment p, the score line traversing the height of corner portion 238 deflects toward the material rotating about the axis comprising line segment p. Similarly, as the material of carton blank 200 disposed upon one side of the axis comprising line segment p is rotated about the axis comprising line segment p toward the material of carton blank 200 disposed upon the adjacent side of the axis comprising line segment p, the score line traversing the height of corner portion 248 deflects toward the material of carton blank 200 rotating about the axis comprising line segment p.

Likewise the corner portions 246, 236 deflect generally in a direction toward the material of carton blank 200 disposed on either side of the axis comprising line segment q during rotation of the material disposed upon either side of the axis comprising line segment q about the axis comprising line segment q. Corner portions 242, 232 deflect generally in a direction toward the material of carton blank 200 disposed on either side of the axis comprising line segment r during rotation of the material disposed upon either side of the axis comprising line segment r about the axis comprising line segment r. Further, corner portions 240, 230 deflect generally in a direction toward the material of carton blank 200 disposed on either side of the axis comprising line segment s during rotation of the material disposed upon either side of the axis comprising line segment sr about the axis comprising line segment s.

Figure 10:
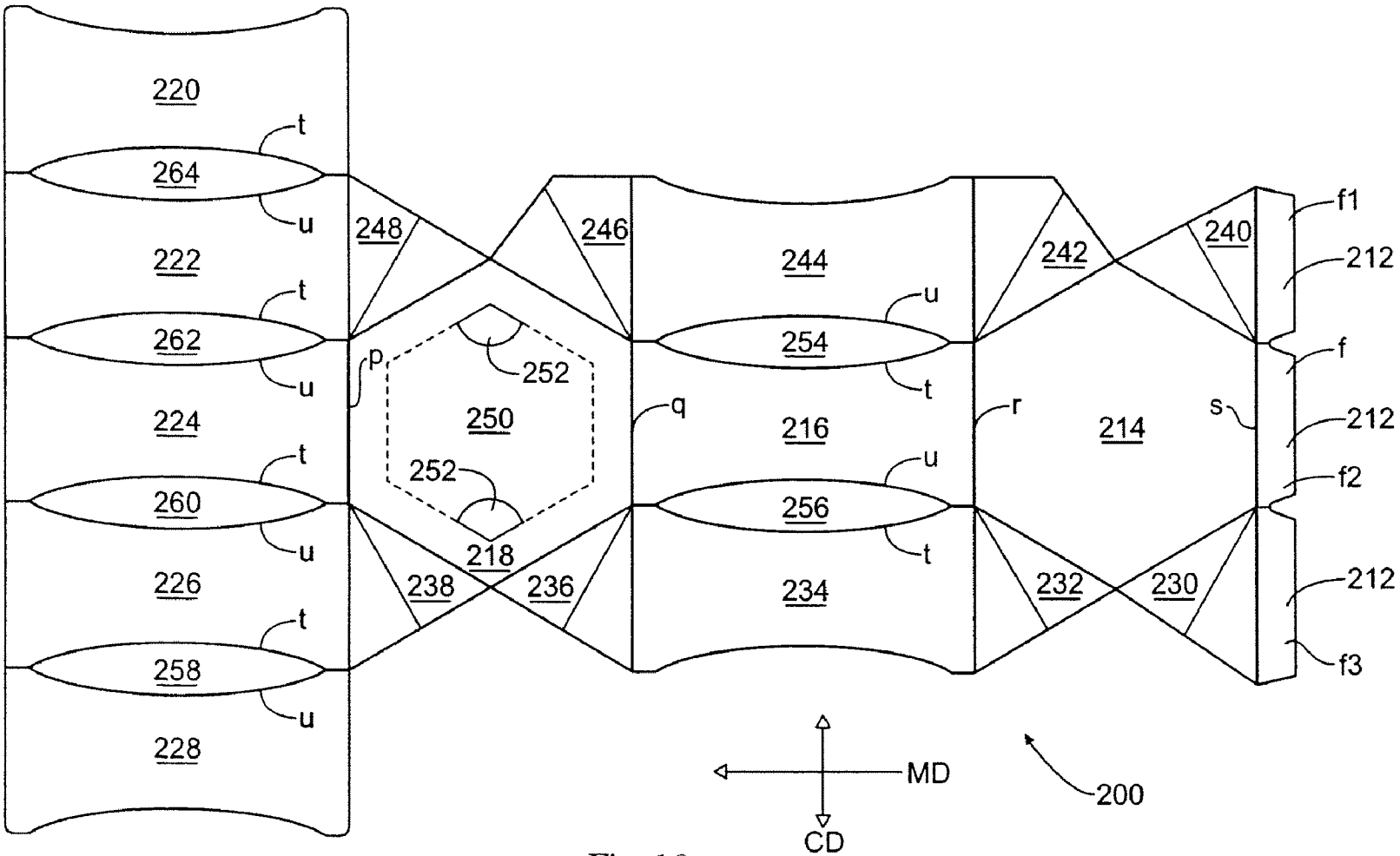
FIG. 10 is a plan view of yet another embodiment of an exemplary blank for a paper package.
Figure 11:
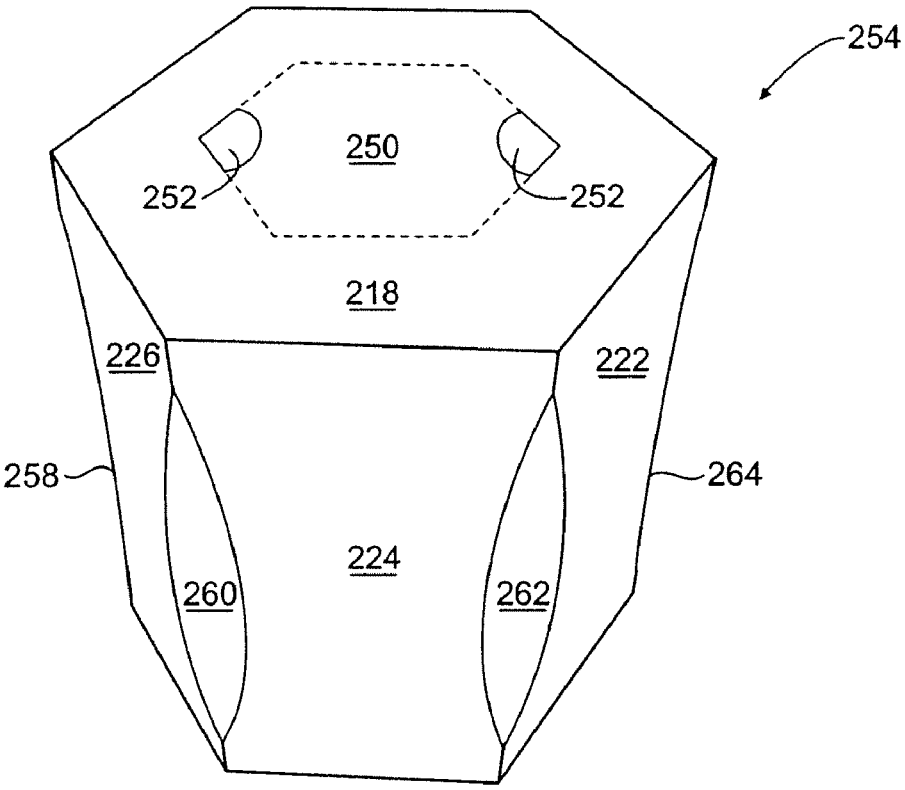
FIG. 11 is a perspective view of yet another exemplary container formed from the blank of FIG. 10; and, FIG. 12 is a plan view of the top of the exemplary container of FIG. 11.

Referring now to FIG. 10 and FIG. 11, scallop regions 254, 256, 258, 260, 262, and 264 are preferably formed by arcuate score lines t, u disposed in corresponding and adjacent side panels. By way of non-limiting example arcuate score line u bounding body panel 224 and arcuate score line t bounding body panel 222 form scallop region 262. Similarly, arcuate score line u bounding body panel 222 and arcuate score line t bounding body panel 220 form scallop region 264, and so on.

Thus, concurrent with the rotation of the material of carton blank 200 disposed upon one side of the axis comprising line segment p about the axis comprising line segment p toward the material of carton blank 200 disposed upon the adjacent side of the axis comprising line segment p and the movement of the score line traversing the height of corner portion 248 toward the material of carton blank 200 rotating about the axis comprising line segment p, score lines t, u forming scallop region 262 rotate out of plane thereby causing body panel 222 to rotate relative to body panel 224. Scallop region 262 is finally disposed in a plane intermediate the intersection of the planes formed by body panel 222 and body panel 224. In a similar manner, scallop region 260 is formed and disposed in a plane intermediate the intersection of body panel 224 and body panel 226, and so on.

Edge f is interrupted by shapes 212 that form three closure tabs: first closure tab f1, second closure tab f2, and third closure tab f3. After the formation of a finally resulting container 254 from carton blank 200, each of first closure tab f1, second closure tab f2, and third closure tab f3 can be fixably, or even removeably attached to side panel 222, side panel 224, and side panel 226 respectively.

Figure 12:
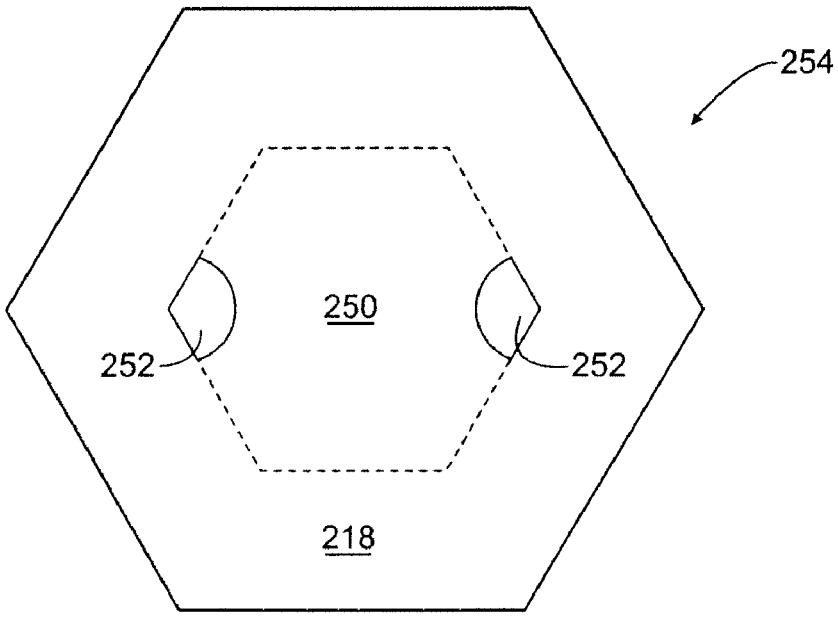

Referring to FIGS. 10-12, access panel 250 is preferably disposed within top portion 218. However, one of skill in the art would readily realize that an access panel could also be disposed within bottom portion 214. Optionally, one of skill in the art could dispose an access panel 250 in both top portion 218 and bottom portion 214 to enable dispensing of product dispose within finally formed container 254 from either end of finally formed container 254. Finger grip region 252 can be formed within container blank 200 as a portion of access panel 250 or as part of top portion 218 to enable removal of access panel 250 from the finally formed container 254 to provide access to any product contained within finally formed container 254.

The dimensions and values disclosed herein are not to be understood as being strictly limited to the exact dimensions and values recited. Instead, unless otherwise specified, each such dimension and/or value is intended to mean both the recited dimension and/or value and a functionally equivalent range surrounding that dimension and/or value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A blank of foldable material, said blank comprising:

a flat, substantially rectangular, blank of foldable material having top, bottom, left and right side edges, and at least five interconnected body panels disposed between said left and right side edges, each of said panels extending from said top edge to said bottom edge;

said top edge and said bottom edge having a plurality of peaks and valleys, a first portion of said plurality of peaks and valleys being joined by curvilinear lines and a second portion of said peaks and valleys being joined by straight lines, said curvilinear lines joining said peaks and valleys of said top edge being adjacent at least one of said straight lines joining said peaks and valleys of said top edge;

a first plurality of identical arch-shaped fold lines disposed adjacent said top edge and said bottom edge and a first plurality of straight fold lines, said arch-shaped fold lines being arranged side by side and each of said arch-shaped fold lines meeting and terminating at points on the valleys of either said top or bottom edges and a point on one of said straight fold lines, said straight fold lines connecting the peaks of said top and bottom edges;

a second plurality of arch-shaped fold lines, each of said second plurality of arch-shaped fold lines being disposed between and connecting adjacent arch-shaped fold lines of said first plurality of arch-shaped fold lines;

a third plurality of arch-shaped fold lines, each of said third plurality of arch-shaped fold lines being disposed between and connecting adjacent arch-shaped fold lines of said first plurality of arch-shaped fold lines, said second and third plurality of arch shaped fold lines being disposed generally parallel to each other and forming a first plurality of regions therebetween; and, whereby joining the right and left side edges to first form a cylinder having a circumference defined by said at least five interconnected body panels and then folding the top edge inward and folding the bottom edge inward forms a substantially flat panel at the top and a substantially flat panel at the bottom.

2. The blank of claim 1 wherein said plurality of straight vertical lines further comprise a series of perforations that separate adjacent distal ends of each of said at least five interconnected body panels.

3. The blank of claim 1 wherein said plurality of interconnected body panels further comprises six body panels.

4. The blank of claim 3 further comprising a score line disposed in one of said at least five interconnected body panels.

5. The blank of claim 1 wherein said first plurality of arch-shaped fold lines and said second plurality of arch-shaped fold lines are pre-creased and said plurality of straight lines are perforated to facilitate folding.

6. The blank of claim 1 wherein said blank is formed from a paperboard material.

7. The blank of claim 1 wherein said blank is foldable into a finally folded container.

8. The blank of claim 7 wherein said finally folded container is suitable for containing a consumer product.

9. The blank of claim 8 wherein said consumer product is selected from the group consisting of tissue products, facial tissues, paper toweling, bath tissue, and combinations thereof.

10. A polygonal container formed from a flat, substantially rectangular, blank of foldable material having left and right side edges, and at least five interconnected body panels disposed between said left and right side edges, said container comprising:

a top edge and a bottom edge wherein said at least five interconnected body panels extend from said top edge to said bottom edge, said top edge and said bottom edge having a plurality of peaks and valleys, a first portion of said plurality of peaks and valleys being joined by curvilinear lines and a second portion of said peaks and valleys being joined by straight lines, said curvilinear lines joining said peaks and valleys of said top edge being adjacent at least one of said straight lines joining said peaks and valleys of said top edge, a first plurality of lines identical arch-shaped fold lines disposed adjacent said top edge and said bottom edge and a first plurality of straight fold lines, said arch-shaped fold lines being arranged side by side and each of said arch-shaped fold lines meeting and terminating at points on the valleys of either said top or bottom edges and a point on one of said straight fold lines, said straight fold lines connecting the peaks of said top and bottom edges a second plurality of arch-shaped fold lines, each of said second plurality of arch-shaped fold lines being disposed between and connecting adjacent arch-shaped fold lines of said first plurality of arch-shaped fold lines, and, a third plurality of arch-shaped fold lines, each of said third plurality of arch-shaped fold lines being disposed between and connecting adjacent arch-shaped fold lines of said first plurality of arch-shaped fold lines, said second and third plurality of arch shaped fold lines being disposed generally parallel to each other and forming a first plurality of regions therebetween; and, whereby joining the right and left side edges forms a cylinder having a circumference defined by said at least five interconnected body panels and then folding the top edge inward along said fold lines and folding the bottom edge inward along said fold lines forms a substantially flat panel at the top and a substantially flat panel at the bottom; and, sealing means disposed within a region of each flat panel circumscribed and formed by said top and bottom edges respectively.

11. The polygonal container of claim 10 wherein said plurality of straight vertical lines further comprise a series of perforations that separate adjacent distal ends of each of said plurality of inter-connected body panels.

12. The polygonal container of claim 10 wherein said at least five interconnected body panels further comprises six body panels.

13. The polygonal container of claim 12 further comprising a score line disposed in one of said at least five interconnected body panels.

14. The polygonal container of claim 10 wherein said first plurality of arch-shaped fold lines and said second plurality of arch-shaped fold lines are pre-creased and said plurality of straight lines are perforated to facilitate folding.

15. The polygonal container of claim 10 wherein said container is formed from a paperboard material.

16. The polygonal container of claim 10 wherein said container is suitable for containing a consumer product.

17. The polygonal container of claim 16 wherein said consumer product is selected from the group consisting of tissue products, facial tissues, paper toweling, bath tissue, and combinations thereof.

18. The polygonal container of claim 10 wherein said sealing means further comprises at least two tabs disposed on and adjacent said top edge, said tabs being engageable in a face-to-face relationship when said top edge is folded inward along said fold lines forming said substantially flat panel.

19. The polygonal container of claim 10 wherein said substantially flat panel comprises a plurality of pie-shaped triangular sections, each of said pie-shaped triangular sections being substantially bounded by two of said plurality of straight vertical lines and one of said second plurality of arch-shaped fold lines.

* * * * *